US006650040B2

(12) United States Patent
Miyazaki et al.

(10) Patent No.: US 6,650,040 B2
(45) Date of Patent: Nov. 18, 2003

(54) CATHODE RAY TUBE HAVING A DEFLECTION YOKE WITH HEAT RADIATOR

(75) Inventors: Shunichi Miyazaki, Takatsuki (JP); Etsuji Tagami, Takatsuki (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 77 days.

(21) Appl. No.: 09/909,180

(22) Filed: Jul. 19, 2001

(65) Prior Publication Data

US 2002/0008459 A1 Jan. 24, 2002

(30) Foreign Application Priority Data

Jul. 24, 2000 (JP) ..... 2000-222301

(51) Int. Cl.[7] ..... H01J 29/70
(52) U.S. Cl. ..... 313/440; 313/46; 165/904
(58) Field of Search ..... 313/440, 46, 45, 313/11, 430, 431; 165/181, 182, 904; 335/210, 217, 300

(56) References Cited

U.S. PATENT DOCUMENTS

| | | | | |
|---|---|---|---|---|
| 4,692,731 A | | 9/1987 | Osinga | |
| 4,737,752 A | | 4/1988 | Kriz | |
| 4,749,975 A | * | 6/1988 | Tokita et al. | 335/217 |
| 5,138,290 A | * | 8/1992 | Togane et al. | 335/210 |
| 5,229,689 A | * | 7/1993 | Forsblad et al. | 315/85 |
| 6,215,239 B1 | * | 4/2001 | Jansen et al. | 313/440 |

FOREIGN PATENT DOCUMENTS

| | | |
|---|---|---|
| EP | 0 424 946 A2 | 5/1991 |
| EP | 0 558 274 A1 | 2/1992 |
| EP | 0 566 303 A1 | 4/1993 |
| JP | 58220343 | 12/1983 |
| JP | 60-175345 | 9/1985 |

OTHER PUBLICATIONS

Development of Litz Wire for Deflection Yoke Coil with Excellent Convergence Characteristics, Nakao et al., Electrical Insulation Conference, 1997 and Electrical Manufacturing & Coil Winding Conference, Sep. 22–25, 1997, New York, pp. 213–218.

* cited by examiner

*Primary Examiner*—Ashok Patel
*Assistant Examiner*—Karabi Guharay

(57) ABSTRACT

The present invention intends to provide a cathode ray tube capable of preventing a rise in temperature of the deflection yoke efficiently, without increasing the size of a display device.

To do so, in the cathode ray tube of the invention, a part of a heat radiator, which is made up of filaments, is attached to a cone part of a horizontal deflection coil so that heat is exchanged between the heat radiator and the horizontal deflection coil, while the other part of the heat radiator extends outside of the deflection yoke. The heat radiator is formed from a plurality of copper wires arranged in parallel to each other in the form of a strip. The copper wires are 0.24 mm in diameter and coated with insulation.

13 Claims, 7 Drawing Sheets

CATHODE RAY TUBE HAVING A DEFLECTION YOKE WITH HEAT RADIATOR

BACKGROUND OF THE INVENTION (1) Field of the Invention

The present invention relates to a cathode ray tube used in computer monitors, television sets and the like.

(2) Related Art

High-resolution displays are used in computer monitors, CAD systems, CAM systems and digital broadcast receiving devices. Such displays are designed to have more scanning lines than conventional displays used for receiving analog broadcasts. With an increase in the number of the scanning lines, a horizontal deflection frequency of the high-resolution displays also increases. For instance, a conventional display for receiving analog broadcasts (NTSC) has a horizontal deflection frequency of 15.75 kHz, whereas a digital high-definition display has a horizontal deflection frequency of 48 kHz, and some displays for use in computers have a horizontal deflection frequency of as much as 120 kHz.

However, the increased horizontal deflection frequency of the high-resolution display causes problems of a copper-loss in a horizontal deflection coil or an eddy-current loss in core materials, and as a result, raises the temperature of a deflection yoke. This increase in temperature leads to a thermal transformation of an insulating frame supporting deflection coils, causing a change in a deflection magnetic field. This results in degradation in picture quality and a loss of credibility of the high-resolution display. If a display having a higher horizontal deflection frequency is developed in the future, the temperature of the deflection yoke would rise accordingly, and a coating of wires of the deflection coil might peel away.

A technique for preventing the temperature of the deflection yoke from rising is disclosed in Japanese Laid-Open Patent Application No. 05-220343. According to the invention, a coned spacer is mounted between the deflection yoke and a glass bulb, so that the spacer dissipates heat in the deflection yoke to the outside of the deflection yoke.

However, the spacer is made of alumina or the like, and since alumina does not have a high heat transfer property, it fails to produce sufficient heat dissipation effects. On the other hand, when a spacer made of a metal plate or the like is used, due to eddy-currents caused by a deflection magnetic field, the spacer itself comes to produce heat. In that case, it is difficult to efficiently prevent the temperature of the deflection yoke from rising.

Another technique is disclosed in Japanese Laid-Open Patent Application No. 05-21018, in which a compressor or the like provides cooling air in between a deflection yoke and a neck glass to prevent the temperature of the deflection yoke from rising.

However, this construction requires devices such as a compressor and a tube for providing the cooling air to be incorporated in a display device. This not only increases the size of the display device, but also increases power consumption and noise.

SUMMARY OF THE INVENTION

The present invention intends to provide a cathode ray tube that is capable of preventing a rise in temperature of a deflection yoke, without increasing the size of a display device.

In order to achieve the above object, the cathode ray tube with a deflection yoke has one or more heat radiators, each of which is made up of filaments, wherein a part of the heat radiator contacts the deflection yoke so that heat is exchanged between the heat radiator and the deflection yoke, while the remaining part of the heat radiator extends outside of the deflection yoke.

In the cathode ray tube, one or more heat radiators are attached so as to contact and exchange heat with the deflection yoke, so that heat in the deflection yoke is conducted through the heat radiators efficiently. In a place where the heat radiator extends outside of the deflection yoke, the heat is dissipated into the air.

Therefore, in the cathode ray tube of the invention, an increase in temperature of the deflection yoke can be efficiently prevented. This is because the filaments made of a metal or other highly conductive materials are not affected by a deflection magnetic field. They do not generate eddy-currents nor produce heat as another heat source.

Furthermore, it is not necessary to incorporate the compressor and the tube for providing cooling air in the cathode ray tube. This does not increase the size of the display device.

It is preferable that the filaments should be made of a paramagnetic or antiferromagnetic metal wire. Specifically, a copper or aluminum wire should be preferably used as a paramagnetic wire, and a chrome wire as an antiferromagnetic wire. Unlike other metal wires with a high heat conductive property, the paramagnetic copper and aluminum wires and antiferromagnetic chrome wires never affect the deflection magnetic field.

It is also preferable to use a cluster strand wire for the filaments. Because a heat radiator made up of the cluster strand wires does not produce any eddy-currents, it can efficiently prevent the temperature of the deflection yoke from rising.

It is also preferable that a heat radiator is formed into a strip by arranging a plural of those metal wires.

It is preferable that each metal wire is individually coated with insulation. Certainly, by using metal wires without insulating coating, contact resistance of the adjacent metal wires can prevent eddy-currents. But metal wires with individual insulation can prevent the occurrence of the eddy-currents with greater efficiency.

For safety reasons, the heat radiators should preferably be electrically insulated at least in a region where it contacts the deflection yoke.

It is preferable that such heat radiators should be placed so as to contact a cone part of the horizontal deflection coil of the deflection yoke, so that heat is exchanged between the heat radiators and the deflection yoke.,This is because the horizontal deflection coil produces a more intense heat than any other part of the deflection yoke does, and because the cone part is heated most.

It is also preferable that the heat radiators should contact the cone part of the deflection yoke in a region along the axis of the cathode ray tube and within 40 mm from a point where the strength of a horizontal deflection magnetic field shows a peak value.

The effect of the present invention can be achieved when each heat radiator is attached to a vertical deflection coil so that heat is exchanged between the heat radiator and the vertical deflection coil.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF PREFERRED EMBODIMENT

Figure 1:
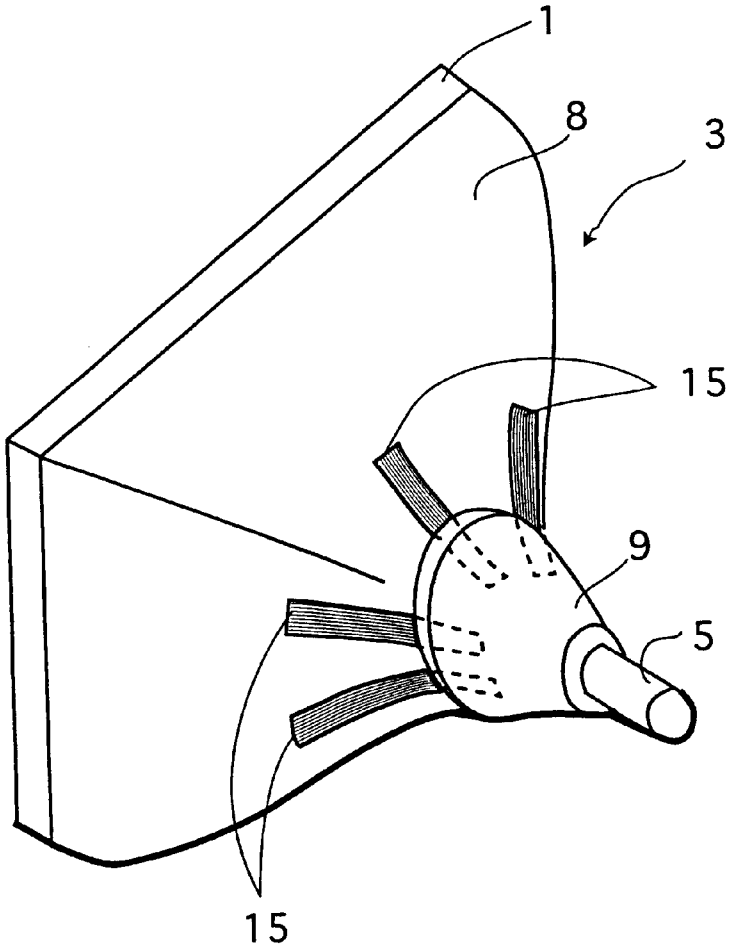
FIG. 1 is a perspective view illustrating a cathode ray tube related to the embodiment of the present invention.
Figure 2:
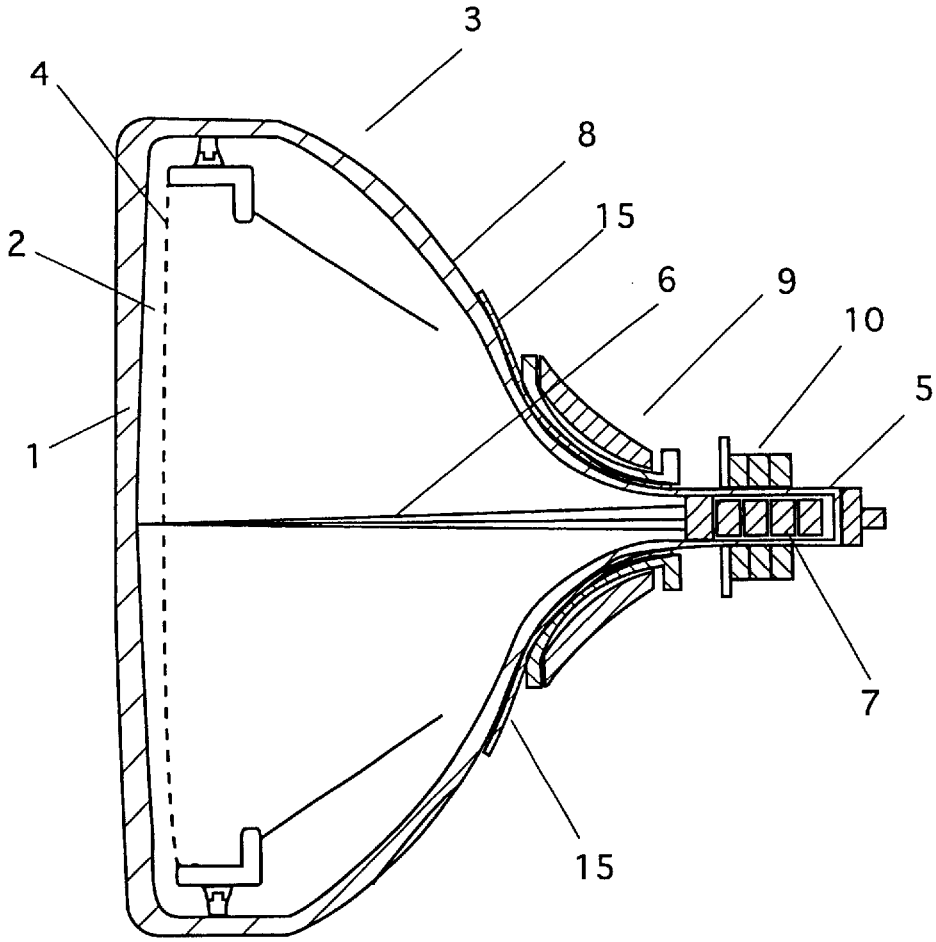
FIG. 2 is a sectional view illustrating the cathode ray tube of FIG. 1.

The following is an explanation of the cathode ray tube related to the embodiment of the invention, with reference to FIG. 1 and FIG. 2.

As can be seen from FIG. 1, the cathode ray tube in this embodiment consists of a glass bulb 3 and a deflection yoke 9 fixed to the glass bulb 3. The glass bulb 3 is composed of a front panel 1, a funnel 8 and a neck 5. A plurality of heat radiators 15 are placed in such a way that one end of each heat radiator is put in between the glass bulb 3 and the deflection yoke 9, and the other end put on the funnel 8 toward the front panel 1.

As shown in FIG. 2, in an inner surface of the front panel 1 a phosphor screen 2 and a shadow mask 4 are situated. Inside the neck 5 of the glass bulb 3 an electron gun 7 is mounted, from which electron beams 6 are emitted. These components constitute a cathode-ray tube. Beside the deflection yoke 9, the glass bulb 3 has a convergence unit 10, on the outer surface, which is composed of two-pole magnets, four-pole magnets and six—pole magnets.

Figure 3:
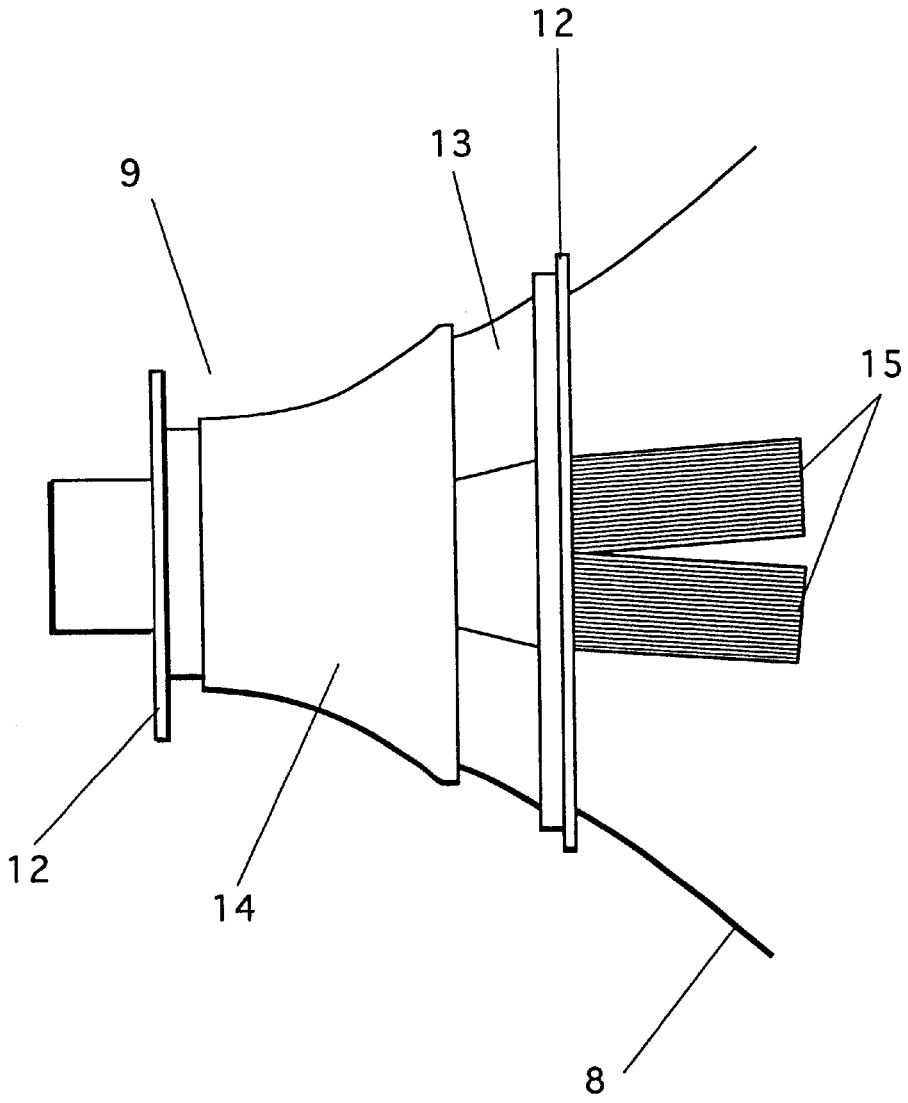
FIG. 3 is a side view showing a deflection yoke with heat radiators attached thereon, which are related to the embodiment of the present invention.

The following is a description of the deflection yoke 9, with reference to FIG. 3.

As can be seen from FIG. 3, the deflection yoke 9 has a horizontal deflection coil 11 (which is not shown in FIG. 3) inside and a vertical deflection coil 13 outside of a resinous frame 12. A ferrite core 14 is situated outside of the vertical deflection coil 13.

The heat radiators 15 are placed in an area stretching across an inner surface of the deflection yoke 9 and the funnel 8 of the glass bulb 3.

Figure 4:
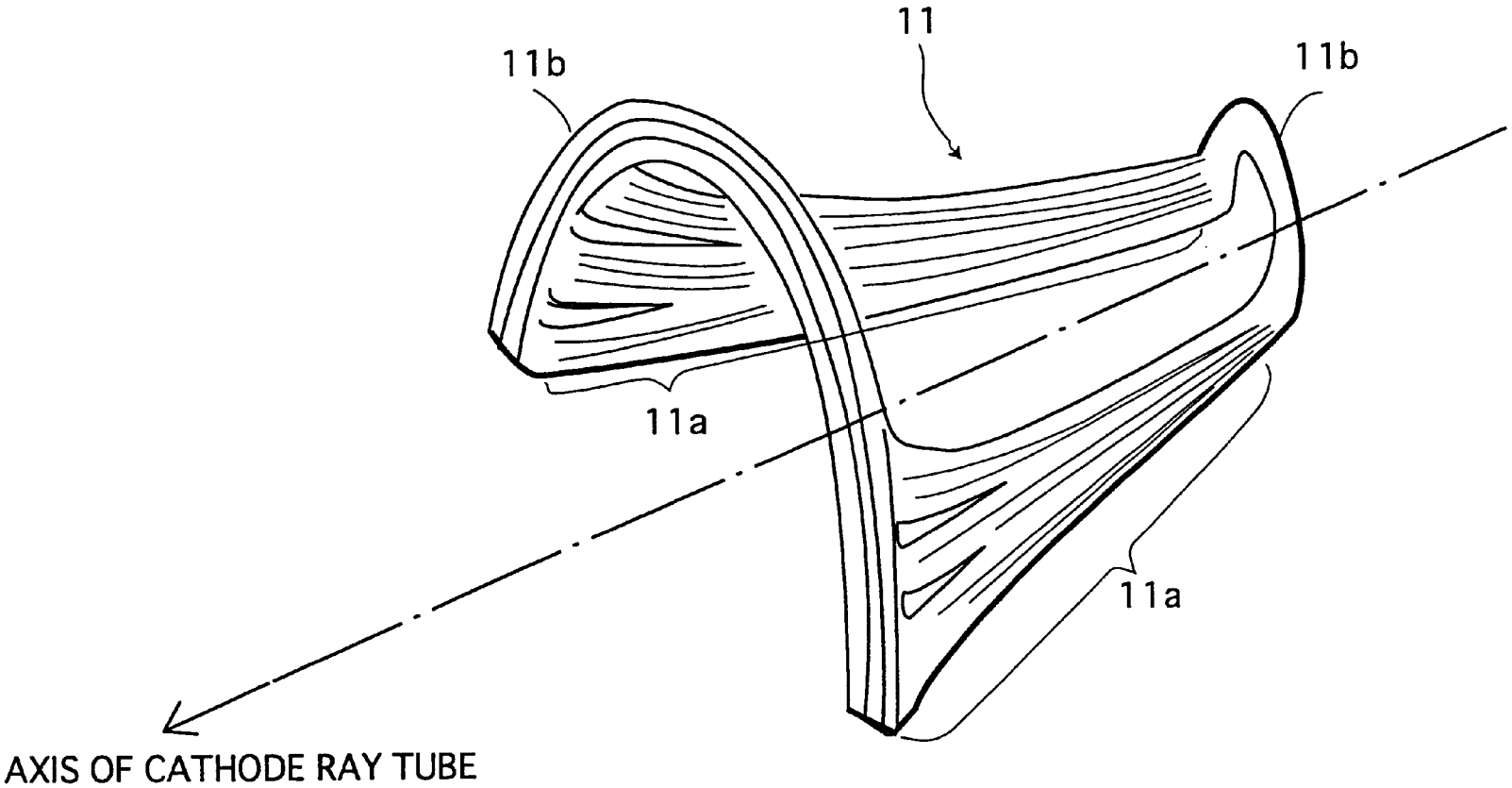
FIG. 4 is a perspective view illustrating a horizontal deflection coil.

As can be seen from FIG. 4, the horizontal deflection coil 11 consists of two cone parts 11*a*, by which a deflection magnetic field is produced when a current flows through the coil, and two bend parts 11*b* which links the cone parts 11*a*. This type of coil is called a saddle-type coil.

Figure 5:
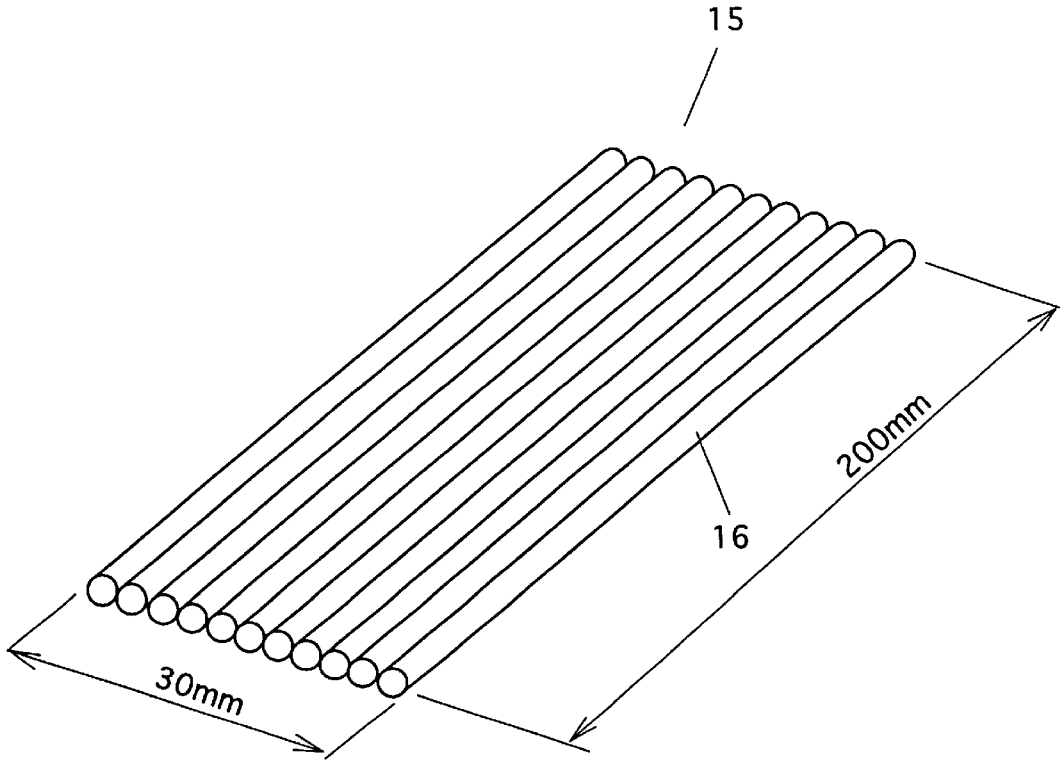
FIG. 5 is a block diagram showing a construction of one of the heat radiators related to the embodiment of the present invention.

The following is a description of the heat radiators 15, with reference to FIG. 5.

As shown in FIG. 5, each heat radiator 15 is made up of a plurality of copper wires 16, which is enamel-clad. They are arranged in the form of a strip so that none of them cross with each other. Specifically, the heat radiator 15 is composed of 110 enamel-clad copper wires 16 each of which is 0.24 mm in diameter and 200 mm long. They are arranged so that none of them cross with each other, and bonded with a resin to form a strip of 30 mm wide. The size of the strip may be changed according to the size and shape of the horizontal deflection coil 11.

The reason for using the enamel-clad copper wires 16 is to prevent the occurrence of eddy-currents as much as possible. The insulating coating is also effective in preventing a short circuit of the copper wires 16 and the horizontal coils when an insulating coating of the wires of the horizontal deflection coil has a pinhole or the like.

It is not necessary, however, to coat each copper wire 16 with enamel coating. It is possible to coat a formed strip heat radiator comprising bare copper wires with insulation. It is also possible to coat only a portion of the formed heat radiator where the heat radiator contacts the horizontal deflection coil. Nevertheless, it is preferable to use the copper wires 16 that are insulated with an enamel coating each, in order to prevent the eddy-currents as much as possible.

With the copper wires 16 arranged in parallel to each other, the heat radiator 15 does not generate any eddy-currents, which would be generated in a metal radiating plate. The heat radiator does not produce heat, neither. Therefore, the heat radiator with this construction can dissipate heat in the deflection yoke 9 to the outside efficiently.

The heat radiator 15 is easy to make and attach since arranging the copper wire 16 forms it. Therefore, they do not increase the size or weight of a display device.

Figure 6:
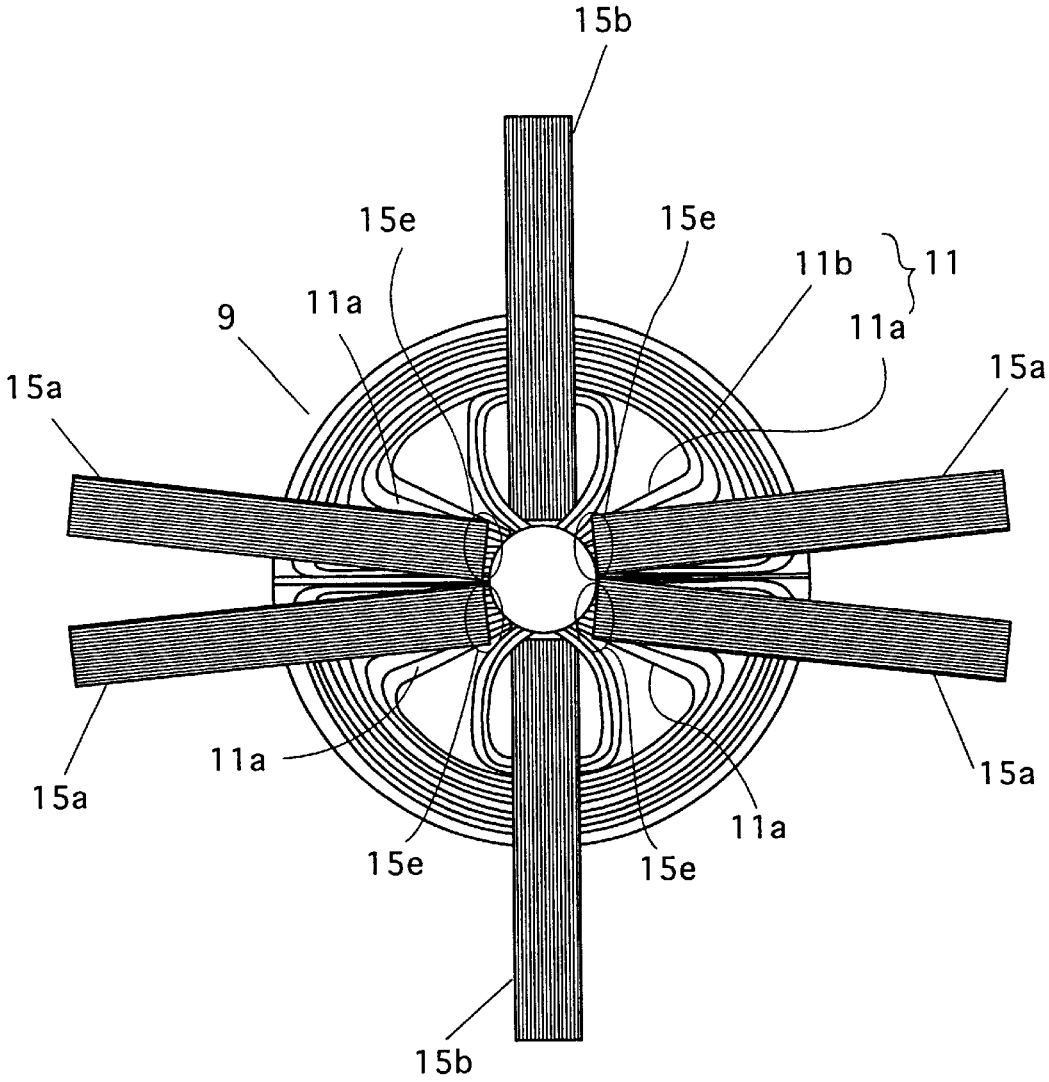
FIG. 6 is a front view illustrating the deflection yoke with the heat radiators attached thereon, which are related to the embodiment of the present invention.

The following is a description of how to attach the heat radiators 15 to the horizontal deflection coil 11, with reference to FIG. 6. FIG. 6 shows the horizontal deflection coil 11 seen from the front panel 1.

As shown in FIG. 6, the cathode ray tube in this embodiment has four heat radiators 15*a* in a cone part 11*a* and two heat radiators 15*b* in a bend part 11*b*. The heat radiators 15*b* are inserted into the deflection yoke 9 and so are the heat radiators 15*a*. The heat radiators 15*a* and 15*b* have the same construction.

Part of each of the heat radiators 15*a* and 15*b* is inserted into the deflection yoke 9, so that it fits neatly between the horizontal deflection coil 11 and the glass bulb 3 as shown in FIG. 2.

Although not shown in the drawings, the heat radiators 15*a* and 15*b* are fixed by means of glass cloth tapes. The glass cloth tapes are used, when moving a display device, to prevent the heat radiators 15*a* and 15*b* from falling off the deflection yoke 9 and heat transfer rate of the display device from falling.

The following describes a location 15*e* for the heat radiators 15*a* and 15*b* to be attached along the axis of the cathode ray tube. The strength of the horizontal deflection magnetic field, when measured along the axis of the cathode ray tube, reaches a peak at a particular point inside the deflection yoke 9. In terms of heat transfer rate, it is preferable to determine the location 15*e* in the vicinity of the point, because this is the point where the horizontal deflection coil 11 is heated most.

In terms of heat absorbing efficiency, the location 15*e* should most preferably be determined as described above. However, the heat radiators can absorb heat effectively enough in a region anywhere within 40 mm away from the point along the axis of the cathode ray tube.

The point where the horizontal deflection magnetic field reaches a peak is determined by measuring the strength of the deflection magnetic field in the following way. A probe is inserted into the deflection coil while an electric current flows through it. The probe is then moved around to measure the strength of the horizontal deflection magnetic field.

As for the other end of each of the heat radiators 15*a* and 15*b*, it should not contact an panel-side edge of the deflection yoke 9 (a panel-side edge of the resinous frame 12) so that heat in the deflection yoke 9 is absorbed and dissipated by the heat radiator 15 to the outside of the deflection yoke 9. To do so, as much portion of the heat radiator as possible should be preferably protruded. It doesn't matter whether the protruded portion of the heat radiator is placed neatly on the glass bulb 3 as shown in FIG. 2 or not. However, when the heat radiators 15*a* and 15*b* are not in contact with the glass bulb 3, heat is dissipated from a larger area of the heat radiators. This increases heat dissipation efficiency.

The heat radiators 15*a* and 15*b* can be turned back at one end so as to contact an edge of the resinous frame 12 or other parts where temperature is relatively low. By doing so, heat dissipation efficiency of the radiators 15 can be increased.

The cathode ray tube in this embodiment has a simple construction, in which a plurality of the strip heat radiators 15*a* and 15*b* are inserted between the horizontal deflection coil 11 and the glass bulb 3. Therefore, attaching the heat radiators 15*a* and 15*b* does not increase the size of a display device. Furthermore, the cathode ray tube in this embodiment can structurally prevent the occurrence of the eddy-currents in the heat radiators 15, so that a rise in temperature of the deflection yoke 9 is prevented efficiently.

In this embodiment, 110 copper wires of 0.24 mm wide each are used to form the 200 mm long and 30 mm wide heat radiator 15, but any other paramagnetic and heat conductive wires of any size may be used. For instance, highly heat conductive metal wires made of aluminum, lead, gold, silver, tungsten alloy and magnesium alloy may be used. A litz wire and other cluster strand wires may also be used. By using the litz wire, the deflection magnetic field produces lesser eddy-currents.

From a viewpoint of heat dissipation, the location 15*e* for the heat radiators 15 to be attached on the deflection yoke 9 should most preferably be in the vicinity of the point where the strength of the horizontal deflection magnetic field in the horizontal deflection coil 11 reaches a peak. But they are still effective enough if, instead, attached anywhere within 40 mm from the point.

The heat radiators 15 attached to the vertical deflection coil 13 can prevent a rise in temperature of the deflection yoke 9 as effectively.

Each heat radiator 15 may be one-layer strip, a layered product having several one-layer strips, or a product with the copper wires and the like weaved into them.

The heat radiators 15 do not have to be formed-into a strip. Instead, each metal wire can be separately attached to the deflection yoke 9. However, it is easier to attach the formed strip heat radiators 15 to the deflection yoke 9 as shown in this embodiment.

Set of Tests

To confirm the effect of the invention, the following test was conducted.

The cathode ray tube used for a 29-inch model and having 525 scanning lines and a horizontal deflection frequency of 31.5 kHz was used for the test.

Six of the heat radiators 15 were attached to the horizontal deflection coil 11 as shown in FIG. 5. The heat radiators have the following structure:

Width; 30 mm

Length; 200 mm

Arrangement pattern; 110 copper wires arranged in parallel to each other

Diameter of a wire; ø0.24 mm

Figure 7:
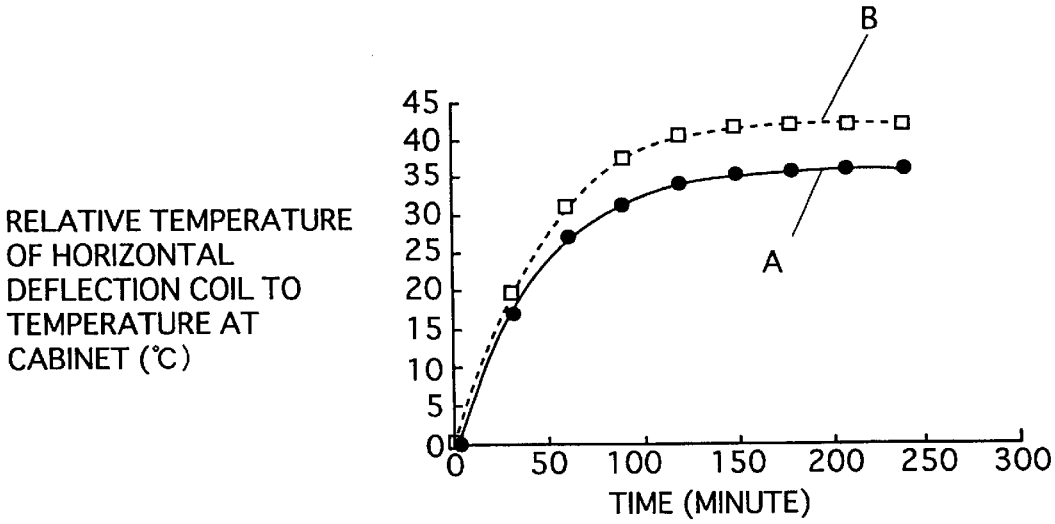
FIG. 7 is a characteristic view showing a change in temperature of the horizontal deflection coil related to the embodiment of the present invention.

In the test, the cathode ray tube was put in a cabinet during operation to read a change in temperature of the horizontal deflection coil for 240 minutes since the start of the operation. FIG. 7 shows a result of the measurement in terms of relative temperature of the horizontal deflection coil to a temperature in the cabinet.

For the sake of comparison, a relative temperature of a conventional cathode ray tube was measured. The heat radiators 15 were not attached to it. In FIG. 7, the relative temperature of the cathode ray tube with the heat radiators 15 is described as curve A, while that of the comparative example is described as curve B.

As can be seen from FIG. 7, the relative temperature almost reached a point of saturation in 180 minutes for both curve A and B. The relative temperature at that time was 35.2° C. for curve A and 41.3° C. for curve B.

Based on the result of the test, it was found that in the cathode ray tube having the heat radiators 15, the temperature of the horizontal deflection coil was about 6 degrees lower than the temperature in the conventional cathode ray tube.

Therefore, in the cathode ray tube having the heat radiators 15, a rise in temperature of the deflection yoke 9 can be prevented efficiently.

Though not shown in the drawings, the effect of the heat radiators 15 on a possible raster deformation or on a convergence is negligible in the cathode ray tube in this embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be constructed as being included therein.

What is claimed is:

1. A cathode ray tube comprising;

a glass bulb of an enveloping structure;

a deflection yoke outside of the glass bulb which includes a horizontal deflection coil and a vertical deflection coil, the horizontal deflection coil being a saddle-type coil including a cone part and a bend part; and a heat radiator which is formed by arranging a plurality of filaments that are paramagnetic or antiferromagnetic metal wires, in the form of a strip, wherein a part of the heat radiator is positioned between the horizontal deflection coil and the glass bulb so as to be in contact with the cone part so that heat can be exchanged between the heat radiator and the horizontal deflection coil, the part of the heat radiator being arranged in parallel with wires of the cone part, and a remaining part of the heat radiator extends outside of the deflection yoke toward the glass bulb.

2. The cathode ray tube of claim 1, wherein the metal wires are covered with insulation.

3. The cathode ray tube of claim 1, wherein the filaments are copper, aluminum or chrome wires.

4. The cathode ray tube of claim 3, wherein the diameter of the copper, aluminum or chrome wires is in a range of 0.05 mm to 0.5 mm inclusive.

5. The cathode ray rub of claim 1, wherein the filaments are cluster strand wires.

6. The cathode ray tube of claim 1, wherein each metal wire is individually covered with insulation.

7. The cathode ray tube of claim 1, wherein the heat radiator consists of a plural of layers, each of which is formed by arranging a plurality of paramagnetic or antiferromagnetic metal wires in the form of a strip.

8. The cathode ray tube of claim 7, wherein each metal wire is individually covered with insulation.

9. The cathode ray tube of claim 1, wherein at least the part of the heat radiator which is in contact with the deflection yoke is electrically insulated.

10. The cathode ray tube of claim 1, wherein the region is located along the axis of the cathode ray tube and within 40 mm from a point where the strength of the horizontal deflection magnetic field reaches a peak.

11. A method of dissipating heat from the deflection yoke of a cathode ray tube, comprising:

coupling the deflection yoke on the outer surface of a glass bulb, the deflection yoke including at least a saddle-type horizontal deflection coil with a cone part and a bend part;

arranging a plurality of paramagnetic or antiferromagnetic metal wires in the form of a strip to create one or more heat radiators;

coupling a first heat radiator between the horizontal deflection coil and the glass bulb, part of the heat radiator being arranged in parallel with wires of the cone part, and a remaining part of the heat radiator extending outside of the deflection yoke toward the glass bulb.

12. The method of claim 11, wherein at least the part of the heat radiator which is in contact with the deflection yoke is electrically insulated.

13. The method of claim 11, wherein each metal wire of the heat radiator is individually covered with insulation.

* * * * *